US006287445B1

(12) United States Patent
Lashmore et al.

(10) Patent No.: US 6,287,445 B1
(45) **Date of Patent: *Sep. 11, 2001**

(54) COATING PARTICLES IN A CENTRIFUGAL BED

(75) Inventors: David S. Lashmore, Lebanon; Glenn L. Beane, Hanover, both of NH (US)

(73) Assignee: Materials Innovation, Inc., Wilebanon, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/990,567

(22) Filed: Dec. 15, 1997

Related U.S. Application Data

(62) Division of application No. 08/568,637, filed on Dec. 7, 1995, now Pat. No. 5,698,081.

(51) Int. Cl.[7] ..... C25D 5/00; C25D 5/34; C25D 3/46; C25D 3/12

(52) U.S. Cl. ..... 205/144; 205/210; 205/270; 205/271; 205/283; 205/291; 205/269; 205/263

(58) Field of Search ..... 204/212, 213, 204/238, 240, 273, 275, 276; 205/137, 143, 144, 210, 291, 271, 270, 283, 269, 263

(56) References Cited

U.S. PATENT DOCUMENTS

| | | | | |
|---|---|---|---|---|
| 2,102,819 | | 2/1937 | Ronci | 91/46 |
| 3,591,466 | * | 7/1971 | Heiman | 204/16 |
| 3,783,110 | * | 1/1974 | Ahmad | 204/12 |
| 5,565,079 | * | 10/1996 | Griego | 205/67 |
| 5,698,081 | * | 12/1997 | Lashmore et al. | 204/212 |

FOREIGN PATENT DOCUMENTS

| | | | |
|---|---|---|---|
| 1596970 | | 7/1970 | (FR) . |
| 53-73433 | | 6/1978 | (JP) . |
| 59-35699 | * | 2/1984 | (JP) . |
| 629034 | | 9/1978 | (SU) . |

* cited by examiner

*Primary Examiner*—Edna Wong
(74) *Attorney, Agent, or Firm*—Fran S. Wasserman

(57) ABSTRACT

An apparatus and method are provided for coating particles in a rotating container. A cathode forms an electrically conductive inner surface of a side wall of the container. An anode is positioned relative to the cathode so as to permit both the cathode and the anode to be immersed together in an electrically conductive fluid. A motor is connected to the container and arranged to cause the container to rotate so as to generate a centrifugal force. Particles are placed in the container, the container is filled with the electrically conductive fluid, and electrical current is caused to pass from the cathode to the anode through the electrically conductive fluid while the container is rotated. The particles rest against the electrically conductive inner surface of the side wall of the container while the electrical current passes from the cathode to the anode, so as to result in deposition of a coating material from the electrically conductive fluid onto the particles.

34 Claims, 4 Drawing Sheets

COATING PARTICLES IN A CENTRIFUGAL BED

This is a Divisional of Ser. No. 08/568,637 filed Dec. 7, 1995 now U.S. Pat. No. 5,698,081.

BACKGROUND OF THE INVENTION

This invention relates to coating of particles, and more particularly electrolytic plating of metals and alloys onto small electrically conductive particles.

It is known to coat particles by such techniques as sputtering, spraying, electroless (autocatalytic) plating, coating with metal organic resonates, and electrolytic plating.

Electrolytic plating of particles involves placing a cathode and an anode in an appropriate electrically conductive solution, placing electrically conductive particles in the solution and in electrical contact with the cathode, and causing an electrical current to pass from the cathode to the anode. The passage of the electrical current through the solution causes reduction of ions in the solution, which results in deposition of a coating material on the particles in electrical contact with the cathode.

One technique for electrolytic plating of particles is described in Lashmore et al., U.S. patent application Ser. No. 08/317,532, filed Oct. 4, 1994, now U.S. Pat. No. 5,603,815, the entire disclosure of which is hereby incorporated herein by reference. In this technique, a bed of particles are placed in a cathodic container that is vibrated during the plating process. The vibration of the container causes fluidized motion of the bed of particles while the particles remain in electrical contact with the cathode, which avoids agglomeration of the particles and thereby enables accurate control of the volume ratio of the coating material to particle material on each of the particles.

By selecting an appropriate volume ratio of coating material to particle material and controlling the ratio for each of the particles, it is possible to engineer the physical and mechanical properties of the composite particles and articles formed from the composite particles. This technique is described in detail in Beane et al., U.S. Pat. No. 5,453,293, the entire disclosure of which is hereby incorporated herein by reference.

SUMMARY OF THE INVENTION

The invention provides an apparatus and method for coating particles in a rotating container. A cathode forms an electrically conductive inner surface of a side wall of the container. An anode is positioned relative to the cathode so as to permit both the cathode and the anode to be immersed together in an electrically conductive fluid. A motor is connected to the container and arranged to cause the container to rotate so as to generate a centrifugal force. Particles are placed in the container, the container is filled with the electrically conductive fluid, and electrical current is caused to pass from the cathode to the anode through the electrically conductive fluid while the container is rotated. The particles rest against the electrically conductive inner surface of the side wall of the container while the electrical current passes from the cathode to the anode, so as to result in deposition of a coating material from the electrically conductive fluid onto the particles.

By providing for generation of a centrifugal force such that the particles rest against the electrically conductive inner surface of the side wall of the container, the invention provides a reliable way to coat small particles (e.g., less than 100 $\mu$m in diameter), which might otherwise make only intermittent electrical contact with the cathode surface due to the tendency of viscous friction to resist the gravitational force on the small particles. This is especially important where the small particles have a low density. Because each of the particles tends to remain in electrical contact with the cathode surface, the invention makes it possible to achieve a high degree of uniformity in the ratio of coating material to particles material on a particle-by-particle basis. The invention is especially effective where the current efficiency through the solution is less than 100 percent. This is because hydrogen might evolve during the deposition process and adhere to the particles, and the centrifugal force resists the tendency of the hydrogen to cause the particles to rise up in the solution and break electrical contact with the cathode surface.

Numerous other features and advantages of the invention will become apparent from the detailed description, drawings, and claims.

DETAILED DESCRIPTION

Figure 1:
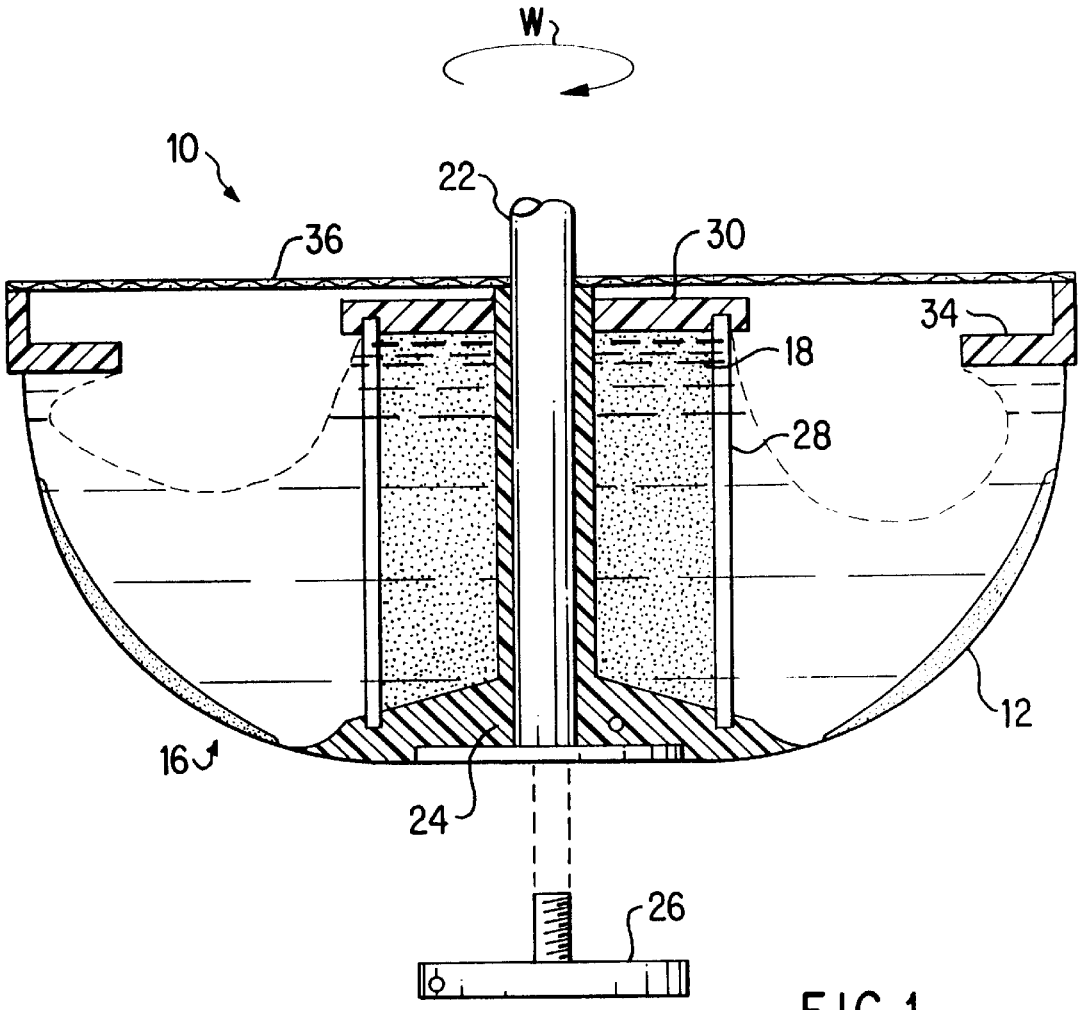
FIG. 1 is a cross-sectional drawing of a centrifugal plating apparatus in accordance with the invention.

With reference to FIG. 1, there is shown a centrifugal device 10 that is used to electrolytically plate metals and alloys, uniformly, onto conductive particles or powders ranging in size from, e.g., 2 to 150 $\mu$ms, which may be metallic, ceramic, intermetallic, or polymeric in nature.

The particles to be coated are placed into centrifugal device 10, and the centrifugal device is caused to spin, thereby centrifugally forcing the particles to contact cathode plate 12. Centrifugal device 10 functions as a deposition chamber to produce batches of coated particles.

The centrifugal device includes dish 16, which is attached to metallic support rod 22 by retaining nut 26. The support rod is surrounded by an insulator 24 such as PVC, TEFLON, or polypropylene. Support rod 22 is configured to be attached to a rotating or stirring motor (not shown).

An anode compartment 18 contains soluble metal particles of the same composition or type as the metal being deposited. This compartment is defined in part by fluid-permeable wall 28, which may be a bag, a membrane, a porous ceramic wall, or simply a titanium screen. The fluid-permeable wall contains the particles being dissolved from the anode. A PVC positioning cap 30 is located at the top of anode compartment 18 and is configured to enable fluid to be pumped into the compartment through positioning cap 30.

During rotation of centrifugal device 10, the particles that are being plated rest on cathode plate 12. The cathode plate functions to inject electrons into the bed of particles. The cathode plate may optionally be specially shaped to provide a circumferential recess to constrain the powder particles when dish 16 is rotated. Because the particles are constrained within the circumferential recess, they are unaffected by any non-uniformity of current distribution between the top and bottom of dish 16. Plating occurs when these electrons are ejected into an electrolytic solution contained within dish 16 and discharge the metal ions in the electrolytic solution as the metal ions deposit on the particle surfaces.

Insulated particle and solution trap 34, which may be a screen or a particle filter, functions as a barrier against which the solution in dish 16 comes to rest as centrifugal device 10 spins. As additional solution is pumped into anode compartment 18, the excess solution passes around particle and solution trap 34 and is ejected from dish 16. Particles are retained within the dish because they are constrained by centrifugal force from passing over the particle and solution trap 34. Porous screen 36 is placed above the rim of dish 16 as an additional barrier for trapping particles that might be ejected from the solution within the dish. The coated particles are retained by the screen as the solution is returned to a holding tank.

Figure 2:
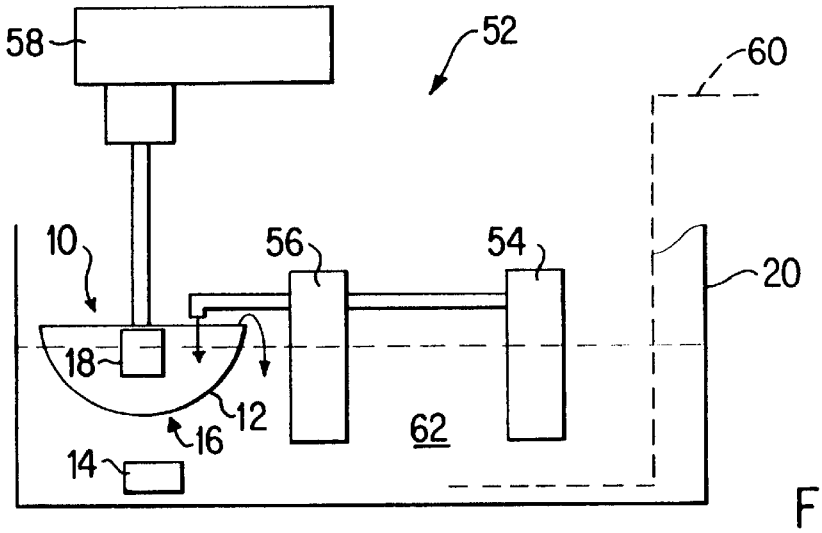
FIG. 2 is a schematic block diagram of a coating system incorporating the centrifugal plating apparatus of FIG. 1.

With reference to FIG. 2, a system 52 is shown that enables solution to be continuously pumped through centrifugal device 10. This is important because of the limited volume of fluid that can be contained within dish 16 and because of the limited ratio of anode to cathode area. Holding tank 20 holds a large amount of the electrolytic fluid 62, which is pumped into centrifugal device 10 by pump 54 through filter 56. In one embodiment, the solution is pumped directly into the top of the anode compartment. In another embodiment, the solution is pumped into the anode compartment through sparging nozzles dispersed throughout the anode compartment. The solution exits from centrifugal device 10 as shown in FIG. 2. Heater 60 is provided for maintaining the electrolytic solution at a desired temperature.

Figure 3:
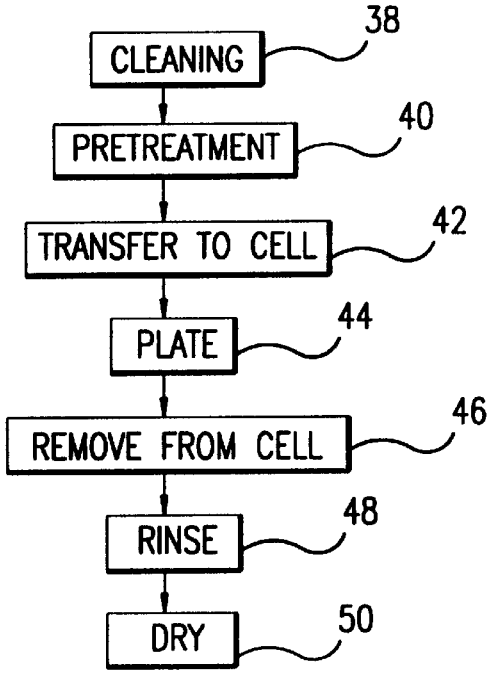
FIG. 3 is a flowchart diagram of a process of coating particles using the centrifugal plating apparatus of FIG. 1.

The procedure for coating particles generally follows the steps set forth in FIG. 3.

The particles to be coated each have a particular set of cleaning (step 38) and pre-treatment (step 40) procedures that must be followed, depending on the particular particles material that is being used. The particles are then transferred into the dish of the centrifugal device (step 42), which is filled with an appropriate electrolytic solution. A stirring motor 58 (FIG. 2) causes the centrifugal device to spin while an electrical current is passed between the cathode and the anode compartments in order to plate the particles (step 44).

In the initial stages of deposition, the particles, which are subject to centrifugal force, gravitational force, frictional forces, and viscous forces, tend to centrifugally contact the upper parts of the walls of dish 16. The particles also tend to follow the convective currents in the solution. Following a build-up of the plating material on the particles, the particles tend to settle towards the bottom of the vessel.

During the plating process, the following parameters of the electrolytic solution are monitored and controlled: the metal ion concentration, temperature, pH, anion activity (Fl—, Cl—, $SO_4$—, etc.), flow rate, coulombs passed, and surface tension. The rate of rotation of the centrifugal device is also controlled. All of these parameters are selected based on the particle material and the material of the coating to be plated onto the particles.

During the plating step, the particles are agitated, over a period of time, to ensure that the particles do not become agglomerated to the walls of the centrifugal device or to each other, and thereby to ensure that each of the particles becomes uniformly coated with the same thickness of coating material for each particle. When stirred the particles act as a fluidized bed of powder in much the same manner as the above-mentioned, U.S. patent application Ser. No. 08/317,532, filed Oct. 4, 1994 by David S. Lashmore et al. Thus, the bed of particles in centrifugal device 10 during the coating process may be referred to as a centrifugal fluidized bed.

The agitation may be done in a number of ways. In one method, the particle-solution mix is manually stirred for ten seconds every ten minutes. The production capability using this method is expected to be about one kilogram of coated particles per day. In another method, an ultrasonic transducer 14 is placed in the solution in holding tank 20, near dish 16, as shown in FIG. 2. Ultrasonic transducer 14 causes the particles to be continuously or intermittently cavitated off cathode plate 12. Alternatively, the particles are mechanically agitated. In another method, the particles are caused to be agitated by changing the velocity of rotation of the centrifugal device, or even reversing the direction of rotation. Alternatively, the centrifugal device is vibrated.

The plating process continues until a certain charge measured in coulombs has passed from the cathode to the anode. When the process is working well, there is little coating build-up on the walls of the centrifugal device. Rather, most of the coating build-up occurs on the surfaces of the particles. Thus, by stopping the plating process as soon as the appropriate amount of charge has passed through the solution, it is possible to carefully control the amount of coating on each of the particles. The thickness of the coating should be almost identical from particle to particle because the agitation of the particles ensures that they do not become agglomerated to the walls of the centrifugal device or to each other.

When the plating process is complete, the particles are removed from the centrifugal device (step 46). Following rinsing of the coated particles (step 48), the coated particles are dried (step 50) in any of a number of different ways such as hot air drying, rinsing with a water-absorbing organic solution, spin drying, etc.

The coating process can be scaled up to production quantities (greater than about 10 kilograms per day, and perhaps even larger than 200 kilograms per day per coating cell), by automating the powder transfers into and out of centrifugal device 10.

EXAMPLES

We describe below appropriate parameters for formation of copper-coated aluminum particles, nickel-coated silicon carbide particles, and nickel-coated silicon carbide particles coated with copper in a prototype 12"-diameter cell.

In one process of coating aluminum particles with copper the following parameters are used:

pyrophosphate: 240 grams per liter;

copper: 12 grams per liter;

pH: 8.75;

temperature: 23 degrees C;

revolutions per minute: 90;

anode bag: single-layer polypropylene heavy cloth;

particle size: 60- to 120-micron aluminum particles;

anode: Cu 9.99% shot;

voltage: 2 volts;

current: 3 amps.

Immersion deposition can occur using higher temperatures and if fluoride is added to the solution.

In this particular process of forming copper-coated aluminum particles, the concentration of pyrophosphate and copper in the electrolyte is tested, and the composition of the particles and distribution of particle sizes is tested. 50 grams of the particles are soaked for 60 seconds in a 1:4 solution of nitric acid with ½ gram per liter $NH_4F_2$. The particles are then rinsed with ethanol and vacuum dried. The particles are loaded into the centrifugal device and plating occurs for 45 minutes while the centrifugal device is rotated at 90 revolutions per minute, with no pump circulation of the electrolytic solution. After 45 minutes the pump is turned on to circulate the solution through the centrifugal device. The solution within the centrifugal device is stirred every ten minutes in order to keep the particles from agglomerating to the walls of the centrifugal device. Alternatively, the agitation of the particles can occur continuously, for example if an ultrasound transducer is used for this purpose. Plating continues until the desired amount of copper has been plated onto the particles. This is determined by measuring the amount of electrical charge that has passed through the cell. The coated particles are removed from the centrifugal device, rinsed with distilled water, and dried with ethanol. A titration test is performed on the coated particles to ensure that the particles are coated with the desired volume of copper. A thermal conductivity test is also performed to ensure that the coated particles exhibit the desired value of this physical property according to the Rule of Mixtures. The electrolytic solution in the holding tank can be recycled for use in preparing another batch of coated particles. The copper shot anode material is rinsed in water after each run.

In one process of coating doped, semiconductive silicon carbide particles with a strike of nickel, the following parameters are used:

boric acid: 30 grams per liter;

nickel: 84 grams per liter;

chloride: 30 grams per liter $NiCl_2$;

pH: 3.5–4.0 temperature: 50 degrees C;

coulombs (current * time): 78,000 to start voltage: 6 volts;

current: 6 amps;

revolutions per minute: 90;

particle size: −600 mesh Carborundum SiC particles;

anode bag: single-layer heavy cloth;

anode: large nickel balls, ⅛ to ½ in diameter.

In this process of coating silicon carbide particles with a strike of nickel, an EDTA titration is performed to ensure that the nickel concentration in the electrolytic solution is 84 grams per liter. The concentration of boric acid in the electrolyte is tested, and the composition of the particles and distribution of particle sizes is tested. The −600 mesh particles are small enough to pass through a 20 micron filter. In other embodiments, particles are selected having larger diameters but small enough to pass through 60–90 micron filters. 50 grams of the particles are loaded into the centrifugal device and plating occurs while the centrifugal device is rotated at 90 revolutions per minute. The solution within the centrifugal device is stirred every ten minutes in order to keep the particles from agglomerating to the walls of the centrifugal device. Alternatively, the agitation of the particles can occur continuously. The concentration of chloride in the electrolytic solution is monitored by measuring the voltage between the cathode and the anode (the voltage goes up if there is too little chloride), and HCl is added to the solution during the plating process as needed. The surface tension is also monitored, and surfactant is also added to the solution during the plating process as needed to ensure that particles will tend to be completely wetted by the solution. Plating continues until the desired amount of nickel has been plated onto the particles, as determined by measuring the amount of electrical charge that has passed through the cell. The coated particles are removed from the centrifugal device, rinsed with two liters of distilled water, and dried. The magnetic particles coated with a thin strike of nickel are separated from any non-coated nonmagnetic particles that might be present. A titration test is performed on the coated particles to ensure that the particles are coated with the desired volume of nickel. A scanning electron microscopy test is performed to ensure that the particles are completely covered with nickel.

In one process of coating copper onto silicon carbide particles plated with a thin strike of nickel (e.g., coating copper onto the coated particles produced by the process described immediately above) the following parameters are used:

temperature: ambient anode bag: single-layer heavy cloth;

anode: Cu 9.99% shot;

particle size: −600 mesh SiC coated with Ni;

revolutions per minute: 90.

In this particular process, a copper sulfate electrolyte is used. Other copper plating processes can be used such as fluoroborate, methyl sulfonic acid, and pyrophosphate. The sulfate concentration is tested using the methyl yellow test, and the copper concentration is tested using EDTA titration. 50 grams of the particles are loaded into the centrifugal device and plating occurs while the centrifugal device is rotated at 90 revolutions per minute. The solution within the centrifugal device is stirred every ten minutes. Alternatively, the agitation of the particles can occur continuously. The surface tension is monitored, and surfactant is also added to the solution as needed. Plating continues until the desired amount of copper has been plated onto the particles. The coated particles are removed from the centrifugal device and rinsed with distilled water having a pH of 7.5. A titration test is performed on the coated particles to ensure that the particles are coated with the desired volume of copper. A laser flash thermal conductivity test is also performed to ensure that the coated particles exhibit the desired value of this physical property according to the Rule of Mixtures. The copper shot anode material is rinsed after each run.

Processes similar to those described above can be used to produce various other types of coated particles including, for example: Ni, Fe, Cr, or Co on Al; Fe, Ag, Co, Cr, or Cu on SiC; Cu on Fe Sn or on SiC; Rh or Cu on Fe; Ni on Ti; Sn on Ni on Ti; Sn on Ni; Cu on Ni 43; Sn, Ag, or Au on $Ag_3Sn$; Sn, Al Ag, or Au on $Ag_4Sn$; Cu, Co, or Ni on W; Sn or Zn on Cu; and Cu or Al or Fe on graphite or diamond. Diamond particles would first have to be coated with an interfacial coating such as chromium or a cobalt-tungsten alloy to make the particles electrically conductive. Graphite would have to be coated with an interfacial coating such as chromium or a cobalt-tungsten alloy before coating with aluminum to prevent the graphite from reacting chemically with the aluminum. Graphite may also be coated with an interfacial coating such as chromium or a cobalt-tungsten alloy before coating with copper in order to create a strong chemical bond between the interfacial coating and the graphite and a strong metallurgical bond between the interfacial coating and the outer coating.

The technology described herein in general allows any of the following metals or alloys to be coated onto any conductor: Ar, Bi, Cd, Cr, Co, Cu, Ga, Ge, Au, In, Ir, Fe, Pb, Mn, Hg, Ni, Pd, Po, Rh, Rn, Se, Ag, Te, Th, Sn, Cu—Sn, Cd—Cu, Cu—Ni, Cu—Zn, Ag—Zn, Sn—Pb, Mn—Fe, CoW, CoFe, NiCr, NiFe, Ag—Au, Bi—Cu, Cu—Sn—Zn, Ni—P, Ni—B, Co—P, Co—B. The electrolytes do not necessarily have to be aqueous but may be salts or organics.

In some processes the coated particles are heated, or an article made from coated particle materials is heated, to cause a reaction between the particle material and the coating material, to form a desired product. In other processes, the final product is simply the coated powder itself, or an article made from unreacted coated powder, in which cases the properties of the coated powder or the article made from the unreacted coated powder is expected to follow Rule of Mixtures behavior.

Industrial Applications

Coated particles produced in accordance with the methods described above can exhibit engineered intrinsic physical properties (e.g., thermal conductivity or coefficient of thermal expansion) and/or engineered intrinsic mechanical properties (e.g., tensile strength). The intrinsic physical properties (but not the intrinsic mechanical properties) of the coated particles tend to behave in accordance with the Rule of Mixtures, according to which the intrinsic physical properties vary approximately linearly with respect to the ratio of the volume of coating to the volume of particle material. Mechanical properties may vary non-linearly with the ratio of volume of coating to the volume of particle material.

The intrinsic properties of the coated particles are engineered by controlling the volume fraction of coating relative to particle material, which can be accomplished in two ways: 1) by controlling the size of the particles, or 2) by controlling the thickness of coating material.

For example, the particles may consist of, for example, elemental tungsten, and the coating may consist of elemental copper, and the volume fraction of copper to tungsten is 27% to 73%. Copper has a high thermal conductivity of approximately 391 w/m deg.k. (watts per meter-degree kelvin) and a relatively high coefficient of thermal expansion of approximately 17.5 ppm/deg.c. (parts per million per degree centigrade) through the temperature range of 25° C. to 400° C., whereas tungsten has a relatively low thermal conductivity of approximately 164 w/m deg.k. and a relatively low coefficient of thermal expansion of approximately 4.5 ppm/deg.c through the range of 25° C. to 400° C. The copper-coated tungsten particles have a thermal conductivity of approximately 226 w/m deg.k at 25° C. (intermediate between the high thermal conductivity of copper and the lower thermal conductivity of tungsten) and an engineered coefficient of thermal expansion of approximately 8.2 ppm/deg.c. (intermediate between the low coefficient of thermal expansion of tungsten and the higher coefficient of thermal expansion of copper) through the range of 25° C. to 400° C.

Figure 4:
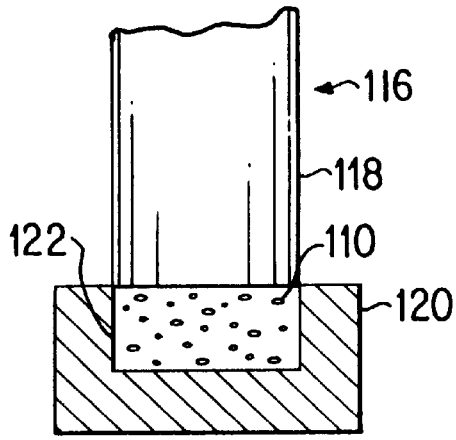
FIG. 4 illustrates consolidating coated particles by compaction.

With reference to FIG. 4, there is shown a die-press device 116, including punch 118 and mold 120, which is used to consolidate coated particles 110 into an article 122 by compaction (coated particles 110 having engineered properties as described above). Compacted article 122 is solid-state sintered (sintered at a temperature below the melting point of the particles and the melting point of the coatings of the particles) or alternatively is liquid-phase sintered (sintered at a temperature above the melting point of the coatings but below the melting point of the particles). The sintering causes bonds to form between the particles to provide a heterogeneous article. The coating of the particles thus serves as a "matrix material" (a material that holds the particles together, forming the article).

Article 122 has engineered intrinsic physical properties (e.g., thermal conductivity and/or coefficient of thermal expansion) and/or intrinsic mechanical properties (e.g., tensile strength) that match those of coated particles 110 from which the article is manufactured. The engineered intrinsic properties of coated particles 110 are exhibited with a high degree of uniformity and isotropy throughout article 122, because each particle 110 is uniformly coated and because there is no inherent randomness of distribution of the differing materials or segregation between the differing materials within article 122. Thus, the intrinsic properties of article 122 are engineered at the "particle level" rather than at the "article level." Article 122 is, for example, a thermal and structural plane for electronic packaging, the thermal and structural plane being engineered to have a coefficient of thermal expansion that matches that of an object to which it is attached and engineered to have high thermal conductivity, as described in connection with FIG. 6 below.

Copper-coated tungsten particles, for example, having a volume fraction of copper to tungsten of 27% to 73%, are compacted in press 116 at 200 tons per square inch of surface area to achieve full density (above approximately 90% density) and the compacted coated particles are solid-state sintered in a hydrogen atmosphere at 1,950 degrees Fahrenheit for approximately one-half hour.

Figure 5:
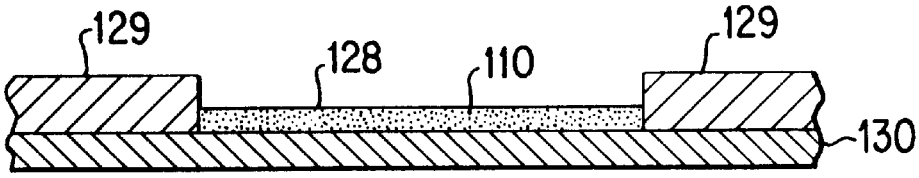
FIG. 5 shows a layer of coated particles plated onto a surface of an article.

Not only can coated particles 110 be consolidated into an article as described above, but the coated particles can also be plated onto objects as a coating. With reference to FIG. 5, there is shown a coating 128 of coated particles 110 having engineered properties. Coating 128 is plated onto a surface of a metal, metal alloy, or non-metal article 130 through plating mask 129. Article 130 may alternatively be an article that is itself formed from coated particles by any of the techniques discussed herein. During plating, coated particles, e.g., copper-coated tungsten particles having a volume fraction of copper to tungsten of 27% to 73%, are placed in a liquid and the coating is formed on an article of, e.g., beryllia by means of one of the plating techniques discussed in detail below. Thus, it possible to create a coating directly on an article without the need to apply a bond between the coating and the article.

Coating 128 has engineered intrinsic physical properties (e.g., thermal conductivity, coefficient of thermal expansion) and/or intrinsic mechanical properties (e.g., tensile strength) that match those of the coated particles from which the coating is manufactured. The engineered intrinsic properties of the coated particles are exhibited with a high degree of uniformity and isotropy throughout coating 128, because each particle is uniformly coated and because there is no inherent randomness of distribution of the differing materials or segregation between the differing materials within coating 128. Thus, the intrinsic properties of coating 128 are engineered at the "particle level" rather than at the "coating level." Note, however, that the plating technique described above can also be implemented where coating 128 does not include coated particles but instead consists of a mixture of different particles selected from two different materials in an appropriate volume fraction.

Figure 6:
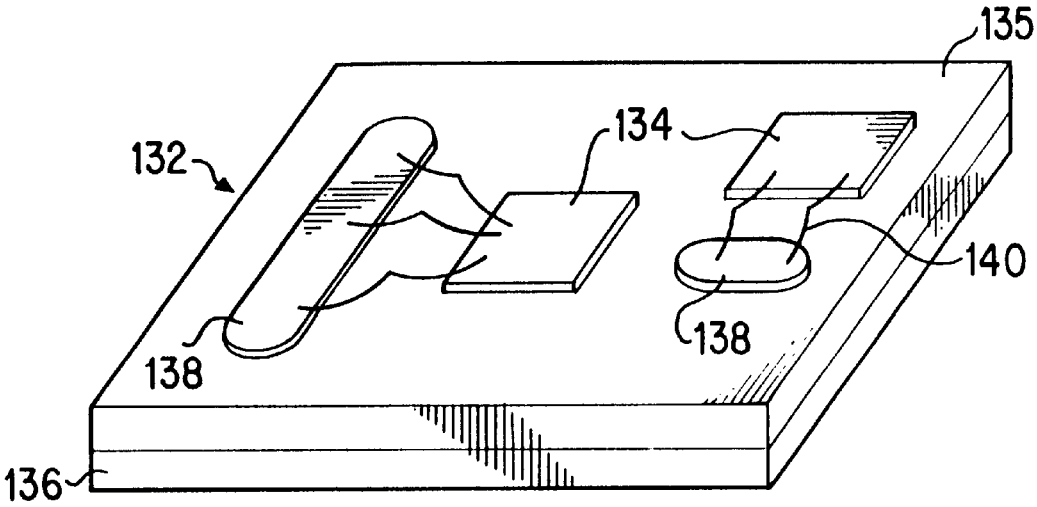
FIG. 6 illustrates electronic packaging that includes a combination structural, thermal, and ground plane manufactured from coated particles, and lead frames manufactured from coated particles.

With reference to FIG. 6, there is shown electronic packaging 132 that includes semiconductor devices 134 mounted on a substrate 135, substrate 135 in turn being supported by a combination structural, thermal, and ground plane 136 formed from coated particles. Semiconductor devices 134 are, e.g., high-power solid-state switch devices (such as may be included in the circuitry of an electric motor vehicle), and produce substantial quantities of heat during operation. Substrate 135, to which semiconductor devices 134 are attached by means of an adhesive bond, a diffusion bond, hard or soft solder, or brazing, is formed from a material selected to have a coefficient of thermal expansion approximately matching that of semiconductor devices 134, as is known in the art, in order to facilitate the attachment of semiconductor devices 134 to substrate 135. Structural plane 136 is manufactured in accordance with the present invention from coated particles. The particle material, the coating material, and the volume fraction of the coating material relative to the particle material are selected so that structural plane 136 has high thermal conductivity (to enable it to function as a heat spreader and thermal plane), and yet has a coefficient of thermal expansion substantially matching the coefficient of thermal expansion of substrate 135. Both the thermal conductivity and the coefficient of thermal expansion are highly uniform and isotropic throughout structural plane 136.

Substrate 135 is formed, e.g., of aluminum nitride having a coefficient of thermal expansion of approximately 4.4 ppm/deg.c through the range of 25° C. to 400° C. Structural plane 136 is made from copper-coated tungsten particles having a volume fraction of copper to tungsten of approximately 27% to 73%. This volume fraction provides a thermal conductivity of approximately 226 w/m deg.k. and a coefficient of thermal expansion of approximately 8.2 ppm/deg.c. (25° C. to 400° C.).

Structural plane 136 is attached to substrate 135 in the following manner. A thin layer of coated particles is first co-deposited on the lower surface of substrate 135 as shown in FIG. 5, in accordance with techniques described below. Then structural plane 136, which is compacted (such as in the manner discussed above with reference to FIG. 4) but not yet sintered, is placed in contact with the plated surface of substrate 135. The structure is then sintered to cause substrate 135 and structural plane 136 to unite together into a single structure. Alternatively, structural plane 136 is bonded to plated substrate 135 by brazing, hard or soft soldering, diffusion, or adhesive bonding.

Lead frames 138, to which semiconductor devices 134 are attached by means of wire bonds 140 that carry power, ground, input, and output signals to and from semiconductor devices 134, are also manufactured from coated particles in accordance with the present invention to have a coefficient of thermal expansion substantially matching the coefficient of thermal expansion of substrate 135. Substrate 135 is formed, e.g., of beryllium oxide (BeO) having a coefficient of thermal expansion of approximately 7.6 ppm/deg.c. (25° C. to 400° C.), and lead frames 138 are manufactured from copper-coated NICKEL 42 particles (nickel 42 being a nickel-iron alloy) having a volume fraction of copper to nickel 42 of 20% to 80%, a thermal conductivity of approximately 86.78 w/m deg.k., and a coefficient of thermal expansion of approximately 8.1 ppm/deg.c (25° C. to 400° C.). Alternatively, lead frames 138 may be manufactured from the same types of coated particles from which structural plane 136 is manufactured. Lead frames 138 are plated, through a plating mask, directly onto the upper surface of substrate 135, in accordance with techniques described above in connection with FIG. 5. In one embodiment lead frames 138 are sintered to cause the lead frames to reach a desired density.

Even given the high power levels, thermal densities, and operating frequencies that are characteristic of new power electronics technologies, and the large and rapid changes in temperature that consequently typically occur during operation of semiconductor devices 134, cracks and delaminations are not likely to occur at the junctions between substrate 135 and lead frames 138 and between substrate 135 and structural plane 136 because of the substantial matching of the coefficients of thermal expansion across the junctions and because of the uniformity and isotropy with which the thermal conductivity and coefficients of thermal expansion are exhibited throughout structural plane 136 and throughout lead frames 138. The overall packaging structure 132 consequently has a long life.

Not only are the engineered intrinsic properties of articles manufactured in accordance with the techniques described above a function of the materials selected for the particles and the coatings of the particles and a function of the volume fraction of coating material relative to the material out of which the particles themselves are formed, but additionally, the behavior of the intrinsic properties of such articles as a function of temperature (e.g., the degree of linearity of the coefficient of thermal expansion as a function of temperature) are affected by the densities of the articles. Thus, by controlling the density of such an article, the behavior of the coefficient of thermal expansion of the article as a function of temperature can be made to approximate the coefficient of thermal expansion of a ceramic (which behaves non-linearly with respect to temperature) within critical process temperature ranges.

Figure 7:
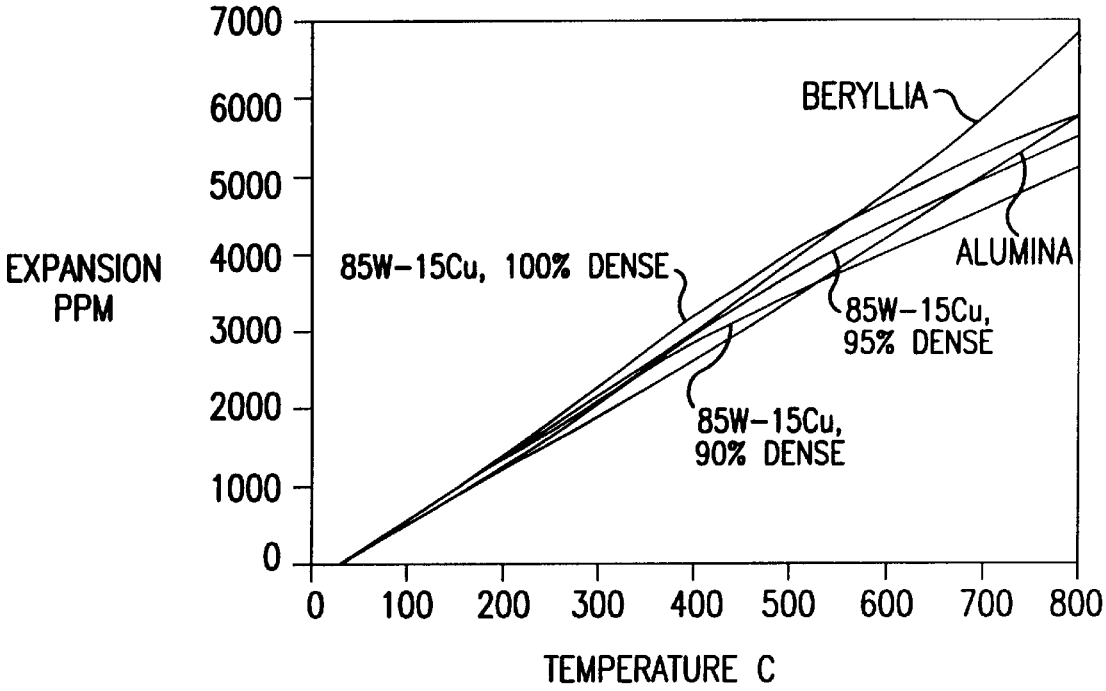
FIG. 7 is a graph illustrating expansion of an article as a function of temperature at densities of 90%, 95%, and 100%.

FIG. 7 illustrates projected thermal expansion, in parts per million as a function of temperature, for articles formed from copper-coated tungsten particles having a volume fraction of copper to tungsten of 27% to 73% (15% copper to 85% tungsten by weight) at densities of approximately 100% (theoretical density), 95%, and 90%, and for two ceramic materials (BeO and $Al_2O_3$) with which the expansion behavior of the article can be approximately matched within critical process temperature ranges by selecting the appropriate density. Note that the extent to which the article expands (i.e., the value of the coefficient of thermal expansion) decreases with decreasing density. The behavior of the coefficient of thermal expansion (or the behavior of other properties such as thermal conductivity) as a function of temperature can thus be selected, and in general physical properties can thus be further refined, by selecting the density at which the article is manufactured. Note that properties of articles manufactured from non-coated particles can also be controlled by selecting the densities at which the articles are manufactured.

Figure 8:
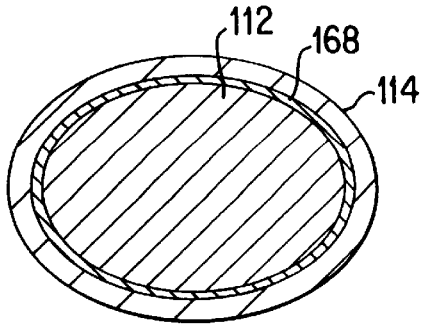
FIG. 8 shows a cross-section of a coated particle in accordance with the invention, the particle having a thin interfacial pre-coat.

With reference to FIG. 8, in some embodiments, in which coating 114 would form only a mechanical bond with particle 112 if coating 114 were plated directly onto particle 112, particle 112 is pre-coated with an extremely thin strike 168 (thickness exaggerated in the Figures) of a pre-coating material and then plated with coating 114. Pre-coat (an interfacial coating) 168 bonds strongly with particle 112 and coating 114, creating a strong, hard to break, chemically bonded, coated particle 110.

Pre-coat 168 also makes it possible to mix particles coated with a thin strike of the pre-coat (but without coating 114) into a molten alloy, where the particles and the alloy would otherwise tend to react with each other. The volume fraction of particles to the alloy material (the particles constituting up to about 50% by volume) is selected to cause the resulting article to have engineered physical properties such as thermal conductivity or coefficient of thermal expansion. Alternatively, the pre-coated particles are added to the alloy to mechanically strengthen the resulting article or to affect its weight.

We now discuss methods of plating articles with coatings of coated particles. With reference again to FIG. 5, an article 130 is plated with a coating 128 of coated particles 110 (article 130 being, e.g., a substrate upon which coating 128 forms, e.g., a lead frame). If article 130 is a metal or metal alloy, coating 128 is electrolytically plated directly onto article 130 by means of a technique described below. If article 130 is nonconductive (e.g., ceramic), however, article 130 is first plated with a thin coating of conductive material, such as the matrix material with which coated particles 110 are coated, through the use of electroless (autocatalytic) plating. The electroless bath includes an aqueous solution containing metal ions, one or more chemical reducing agents, a catalyst, one or more complexing agents, and one or more bath stabilizers, as described above. The metal ions are autocatalytically or chemically reduced by the reducing agent or agents, which causes the metal to be deposited onto article 130. Alternatively, pre-coated or coated particles are placed in the aqueous solution, and the particles are coated with the metal as the metal-coated particles are simultaneously plated onto article 130. Because electroless plating is slower than electrolytic plating, coated particles 110 are electrolytically plated onto the thin conductive layer (by means of the technique described below) as soon as the thin conductive layer is formed, thereby forming coating 128.

Figure 9:
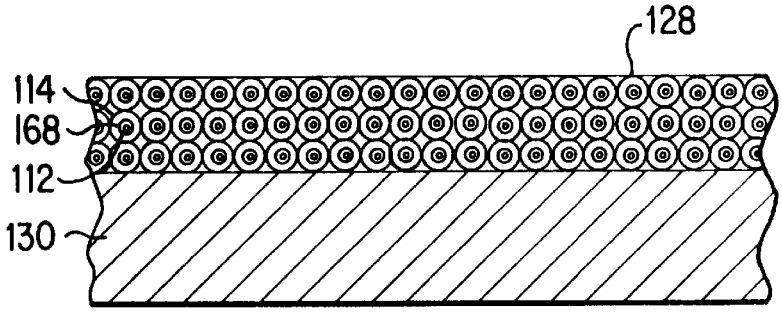
FIG. 9 shows coated particles being electrolytically co-deposited onto an article in conjunction with matrix material.

With reference to FIG. 9, coating 128 is plated onto conductive article 130 (or a non-conductive article metallized with a thin conductive layer as described above) through the use of electrolytic co-deposition of coated particles 110 and matrix material (the material out of which coatings 114 of coated particles 110 are formed) onto article 130. As coated particles 110 are plated onto article 130, matrix material is simultaneously plated around the coated particles to fill the gaps between the coated particles, thereby forming coating 128.

Figure 10:
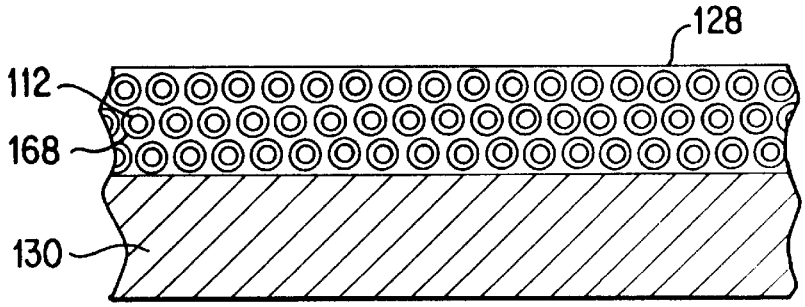
FIG. 10 shows pre-coated particles being electrolytically co-deposited onto an article in conjunction with matrix material.

With reference to FIG. 10, in an alternative electrolytic plating method, matrix material and particles 112 (which are coated with a pre-coat 168 as described above but which are not yet coated with the matrix material) are co-deposited onto article 130. As particles 112 are plated onto article 130 the particles are simultaneously plated with the matrix material to form coating 128.

Alternatively, coating 128 is formed on article 130 by sputtering or spraying coated particles 110 onto the article. Coating 128 is then sintered, after which coating 128 exhibits its selected intrinsic property or properties.

It is possible to engineer many intrinsic properties other than thermal conductivity or coefficient thermal expansion. For example, the electrical conductivity of an article may be engineered in combination with the engineering of other intrinsic properties.

With reference to FIG. 4, particles 110 need not consist entirely of coated particles. Alternatively, a mixture of coated particles combined with other particles (e.g., copper-coated tungsten particles can be combined with copper particles) may be thoroughly mixed and then compacted to form an article 122 having intrinsic properties that are a function of the volume fractions of all of the materials in the mixture, article 122 exhibiting the intrinsic properties isotropically. Alternatively, the coated particles are combined with materials that exhibit one or more intrinsic properties anisotropically, causing the article in turn to exhibit one or more intrinsic properties anisotropically. For example, the coated particles are mixed with crystalline materials that have properties that differ in different directions, the crystalline materials being mixed with the coated particles in a manner such that the crystalline materials tend to be oriented in a common direction. In another example, the coated particles are mixed with carbon fibers, the carbon fibers tending to be oriented in a common direction. The carbon fibers provide tensile strength that varies with respect to direction.

Alternative techniques for manufacture of articles from coated particles include metal injection molding, hot isostatic pressing ("hipping"), cold isostatic pressing ("cipping"), hot or cold isostatic forging, hot or cold roll compacting (which "densifies" consolidated coated particles), and die casting.

If coated particles 122 are compacted to a density approximating "full density" (the density at which the compacted coated particles have "level 2" or "level 3" or "non-interconnected" porosity, a porosity that does not provide interconnected passages passing from one side of the article to another), the sintering process does not increase the density or change the shape of the article. The density of the article, and thus the final dimensions of the article, can be carefully controlled during compaction. Where the particles are formed from a metal or metal alloy (whether the particles are coated with metal or non-coated), pressures of approximately 80 to 200 tons per square inch are typically required to compact the particles to full density.

Figure 11:
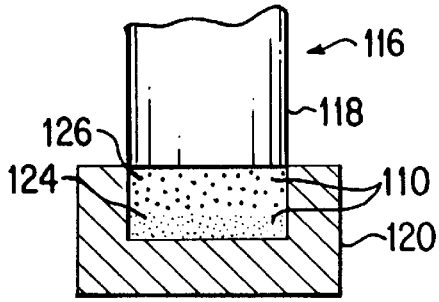
FIG. 11 illustrates consolidating two distinct layers of coated particles by compaction.

With reference to FIG. 11, there is shown a die-press device 116, including punch 118 and mold 120, which is used to consolidate two distinct layers 124 and 126 of particles by compaction to provide an article 125 (not shown) having intrinsic properties that vary from layer to layer. Layers 124 and 126 consist of particles composed of differing materials or having differing volume fractions of the materials from which the particles are formed. The particles are introduced into mold 120 in layers 124 and 126, compacted to a selected density chosen to yield temperature-dependent intrinsic properties (e.g., thermal conductivity and coefficient of thermal expansion) as discussed in connection with FIG. 7, and sintered in a hydrogen atmosphere for about one-half hour. The sintering causes the particles of layers 124 and 126 to bond at the interface between the two layers, to yield a single, layered article.

For example, layer 124 includes copper-coated tungsten particles having a volume fraction of copper to tungsten of 27% to 73% and layer 126 includes elemental copper particles. Layer 124, after compaction, has a thermal conductivity of approximately 225.78 w/m deg.k. and a coefficient of thermal expansion of approximately 8.28 ppm/deg.c. Layer 126, after compaction, has a thermal conductivity of approximately 390 w/m deg.k. and a coefficient of thermal expansion of approximately 18.04 ppm/deg.c. Layered article 125 is connected directly between two objects having different coefficients of thermal expansion that match the coefficients of thermal expansion of layers 124 and 126. For example, layer 124 is attached to a beryllia ceramic and layer 126 is diffusion bonded to a copper heat sink.

Thus, layered article 125 is connected directly between two objects having different coefficients of thermal expansion. The boundary between different coefficients of thermal expansion occurs within layered article 125, rather than at one or more interfaces between surfaces of the article and other devices. Moreover, there is only one boundary (located between the two layers inside layered, discrete article 125) at which there is mismatch of coefficients of thermal expansion, rather than a series of such boundaries located between consecutive layers of dissimilar articles. Because the copper bonds between the particles are compliant and malleable, the copper bonds tend to absorb the stress of thermal expansion, and consequently there is no cracking or delamination at the junction between the two layers. Moreover, because the bonds are compliant and because all of the bonds are formed of the same material (all copper-to-copper bonds), the bonds tend to absorb stress equally, and the article consequently does not tend to bow or ripple with large changes in temperature. In an alternative embodiment there are more than two layers within article 25 (not shown) and consequently there is more than one internal boundary at which there is a mismatch of coefficients of thermal expansion. The mismatch at each boundary is less than the mismatch that occurs when there is a single boundary within layered article 25 (not shown).

There has been described an apparatus and method for coating particles. It will be apparent that numerous modifications of and departures from the specific embodiments described herein are possible without departing from the inventive concepts set forth in the claims.

What is claimed is:

1. A method of coating particles, comprising the steps of:

placing said particles in a container comprising at least one side wall, a cathode forming an electrically conductive inner surface of said side wall of said container;

filling said container with an electrically conductive fluid so as to immerse said cathode together with an anode; and creating a fluidized bed of said particles by causing said container to rotate so as to generate a centrifugal force while simultaneously agitating said particles, and while causing electrical current to pass through said container, said centrifugal force and said agitating causing said particles to remain immersed in the electrically conductive fluid and remain in electrical contact with said electrically conductive inner surface of said side wall of said container while said electrical current passes from said cathode to said anode, so as to result in substantially uniform deposition of a coating material from said electrically conductive fluid onto said particles.

2. A method in accordance with claim 1, wherein said step of agitating said particles comprises cavitating said particles off of said cathode through use of an ultrasonic transducer placed in said electrically conductive fluid in the vicinity of said container.

3. A method in accordance with claim 1, wherein said step of agitating said particles comprises changing the velocity of rotation of said container.

4. A method in accordance with claim 1, wherein said step of agitating said particles comprises vibrating said container.

5. A method in accordance with claim 1, further comprising the steps of cleaning and pre-treating said particles before transferring said particles to said container.

6. A method in accordance with claim 1, further comprising the steps of rinsing and drying said particles after removing said particles from said container.

7. A method in accordance with claim 1, further comprising the steps of:

monitoring passage of charge from said cathode to said anode until a predetermined threshold is passed; and removing said particles from said container when said predetermined threshold is passed.

8. A method in accordance with claim 1, wherein said particles comprise aluminum and said coating material comprises copper.

9. A method in accordance with claim 1, wherein said particles comprise aluminum and said coating material comprises nickel.

10. A method in accordance with claim 1, wherein said particles comprise aluminum and said coating comprises iron.

11. A method in accordance with claim 1, wherein said particles comprise aluminum and said coating material comprises chromium.

12. A method in accordance with claim 1, wherein said particles comprise aluminum and said coating material comprises cobalt.

13. A method in accordance with claim 1, wherein said particles comprise silicon carbide and said coating material comprises nickel.

14. A method in accordance with claim 1, wherein said particles comprise silicon carbide and said coating material comprises iron.

15. A method in accordance with claim 1, wherein said particles comprise silicon carbide and said coating material comprises silver.

16. A method in accordance with claim 1, wherein said particles comprise silicon carbide and said coating material comprises cobalt.

17. A method in accordance with claim 1, wherein said particles comprise silicon carbide and said coating material comprises chromium.

18. A method in accordance with claim 1, wherein said particles comprise silicon carbide and said coating material comprises copper.

19. A method in accordance with claim 18, wherein said particles comprise nickel-coated silicon carbide.

20. A method in accordance with claim 18, wherein said particles comprise iron-coated silicon carbide.

21. A method in accordance with claim 1, wherein said particles comprise iron and said coating material comprises rhodium.

22. A method in accordance with claim 1, wherein said particles comprise iron and said coating material comprises copper.

23. A method in accordance with claim 1, wherein said particles comprise titanium and said coating material comprises nickel.

24. A method in accordance with claim 1, wherein said particles comprise titanium and said coating material comprises tin.

25. A method in accordance with claim 24, wherein said particles comprise nickel-coated titanium.

26. A method in accordance with claim 1, wherein said particles comprise nickel and said coating material comprises tin.

27. A method in accordance with claim 1, wherein said particles comprise an alloy of nickel and iron comprised of about 46% by weight of nickel and said coating material comprises copper.

28. A method in accordance with claim 1, wherein said particles comprise a silver-tin intermetallic and said coating material comprises tin.

29. A method in accordance with claim 28, wherein said silver-tin intermetallic comprises $Ag_3Sn$.

30. A method in accordance with claim 28, wherein said silver-tin intermetallic comprises $Ag_4Sn$.

31. A method in accordance with claim 1, wherein said particles comprise tungsten and said coating material comprises copper.

32. A method in accordance with claim 1, wherein said particles comprise copper and said coating material comprises tin.

33. A method in accordance with claim 1, wherein said particles comprise copper and said coating material comprises aluminum.

34. A method in accordance with claim 1, wherein:

said particles have a first value of an intrinsic property;

said particles are placed in said container in a state in which said particles are unattached to each other;

said coating material has a second value of said intrinsic property that differs from said first value such that when said material is applied as said coating on said particles the value of said intrinsic property of the coated particles is a function of said first value and said second value according to a volume of said coating relative to a volume of said particles;

said method further comprises determining the volume of said coating relative to the volume of each of said particles that will make said value of an intrinsic property of each of said coated particles equal to a desired value of said intrinsic property that differs from said first value; and said coating is applied on each of said particles in approximately the determined volume, said particles being unattached to each other while said coating is at least initially applied.

* * * * *